US009988176B2

(12) United States Patent
Kobbe

(10) Patent No.: US 9,988,176 B2
(45) **Date of Patent: *Jun. 5, 2018**

(54) PACKAGE FOR STORING A PRODUCT

(71) Applicant: Braun GmbH, Kronberg (DE)

(72) Inventor: Manfred Kobbe, Frankfurt (DE)

(73) Assignee: The Procter & Gamble Company, Cincinnati, OH (US)

( * ) Notice: Subject to any disclaimer, the term of this patent is extended or adjusted under 35 U.S.C. 154(b) by 317 days.

This patent is subject to a terminal disclaimer.

(21) Appl. No.: 14/699,259

(22) Filed: Apr. 29, 2015

(65) Prior Publication Data

US 2016/0200493 A1 Jul. 14, 2016

(30) Foreign Application Priority Data

Jan. 14, 2015 (EP) ..... 15151067

(51) Int. Cl.
*B65D 75/36* (2006.01)
*B65D 5/50* (2006.01)

(52) U.S. Cl.
CPC ..... *B65D 5/5021* (2013.01)

(58) Field of Classification Search
CPC .. B65D 75/36; B65D 73/0042; B65D 5/5021; G09F 5/04; A61C 19/02; A61C 2202/00
USPC ..... 206/462, 486, 588, 589, 472
See application file for complete search history.

(56) References Cited

U.S. PATENT DOCUMENTS 2,695,097 A 11/1954 Easton
3,203,542 A * 8/1965 Lightner ..... B65D 73/0092 206/462
3,302,844 A * 2/1967 Henry ..... B65D 5/38 229/120.18
3,682,297 A * 8/1972 Austin ..... B65D 5/48014 206/387.11
4,711,348 A * 12/1987 Schluger ..... B65D 5/422 206/232
5,289,917 A * 3/1994 Chabria ..... B42D 15/045 206/232
5,328,089 A * 7/1994 Forbes, Jr. ..... B65D 5/5016 229/120.18
6,112,978 A * 9/2000 Barr ..... B65D 5/48014 206/461
2005/0173291 A1 8/2005 Specker et al.
2005/0252809 A1 11/2005 Aldridge et al.

FOREIGN PATENT DOCUMENTS

EP 2112078 10/2009

* cited by examiner

*Primary Examiner* — Steven A. Reynolds

(74) *Attorney, Agent, or Firm* — Parker D. McCrary; Vladimir Vitenberg

(57) ABSTRACT

A package unitarily formed from a cardboard blank includes a back wall, two hinged lid sections to open and close the package, and a first and second pairs of side walls extending from the back wall. One hinged lid section extends from one of the side walls of the first pair and the other from the other side wall of the first pair. A panel having at least one aperture for receiving the product extends from one side wall to the other side wall of the second pair and is arranged between the back wall and the hinged lid sections when the package is closed. The panel includes at least one reinforcing brace extending substantially perpendicular from the panel towards the back wall.

13 Claims, 4 Drawing Sheets

PACKAGE FOR STORING A PRODUCT

FIELD OF THE INVENTION

The present disclosure is concerned with a package unitarily formed from a cardboard blank for storing a product. The present disclosure is further concerned with a package kit comprising such type of package and a product.

BACKGROUND OF THE INVENTION

Packages made of cardboard material for storing and shipping products, like oral care products or other personal hygiene products are well known in the art. Generally, the product is packed in a first package, which package is then put into a relatively large cardboard box for shipping. Usually, protective padding and/or filling material is inserted into the spacing between the first package and the outer walls of the box to ensure that the product is delivered in a safe and undamaged manner. Typically, the box is tied with a wire or tape. These types of packages are relatively complex and hard to open in a short period of time. In case the recipient wants to return the product back to sender after opening the package, he is usually not enabled to reclose the package in an easy manner. Sometimes, the package gets irreversibly damaged during an opening process so that the package cannot be re-used at all.

While these types of packages provide substantially safe delivery of the product stored therein, they are not as well suited to provide convenient handling of the package. In particular, these types of packages are relatively big and require a relatively large amount of packaging material.

It is an object of the present disclosure to provide a package which is easy to handle, in particular easy to open and easy to re-close, and which package protects the stored product from damages during storage and distribution. Further, it is an object of the present disclosure to provide a recyclable package which minimizes packaging material.

SUMMARY OF THE INVENTION

In accordance with one aspect, a package unitarily formed from a cardboard blank for storing a product is provided that comprises:

- a back wall,
- a first hinged lid section and a second hinged lid section to set the package in an open or a closed position, the first and the second hinged lid sections being opposite the back wall when the package is set in the closed position,
- a first pair of side walls, the side walls of the first pair being arranged opposite each other and extending from the back wall,
- the first hinged lid section extending from one of the side walls of the first pair and the second hinged lid section extending from the other side wall of the first pair,
- a second pair of side walls, the side walls of the second pair being arranged opposite each other and extending from the back wall, and
- a panel comprising at least one aperture for receiving the product, wherein
- the panel extends from one of the side walls of the second pair to the other side wall of the second pair and is arranged between the back wall and the first and the second hinged lid sections when the package is set in the closed position, and wherein

- the panel comprises at least one reinforcing brace extending substantially perpendicular from the panel towards the back wall.

In accordance with one aspect, a package kit is provided that comprises such package and a product.

BRIEF DESCRIPTION OF THE DRAWINGS

The invention is described in more detail below with reference to various embodiments and figures, wherein.

DETAILED DESCRIPTION OF THE INVENTION

Figure 1:
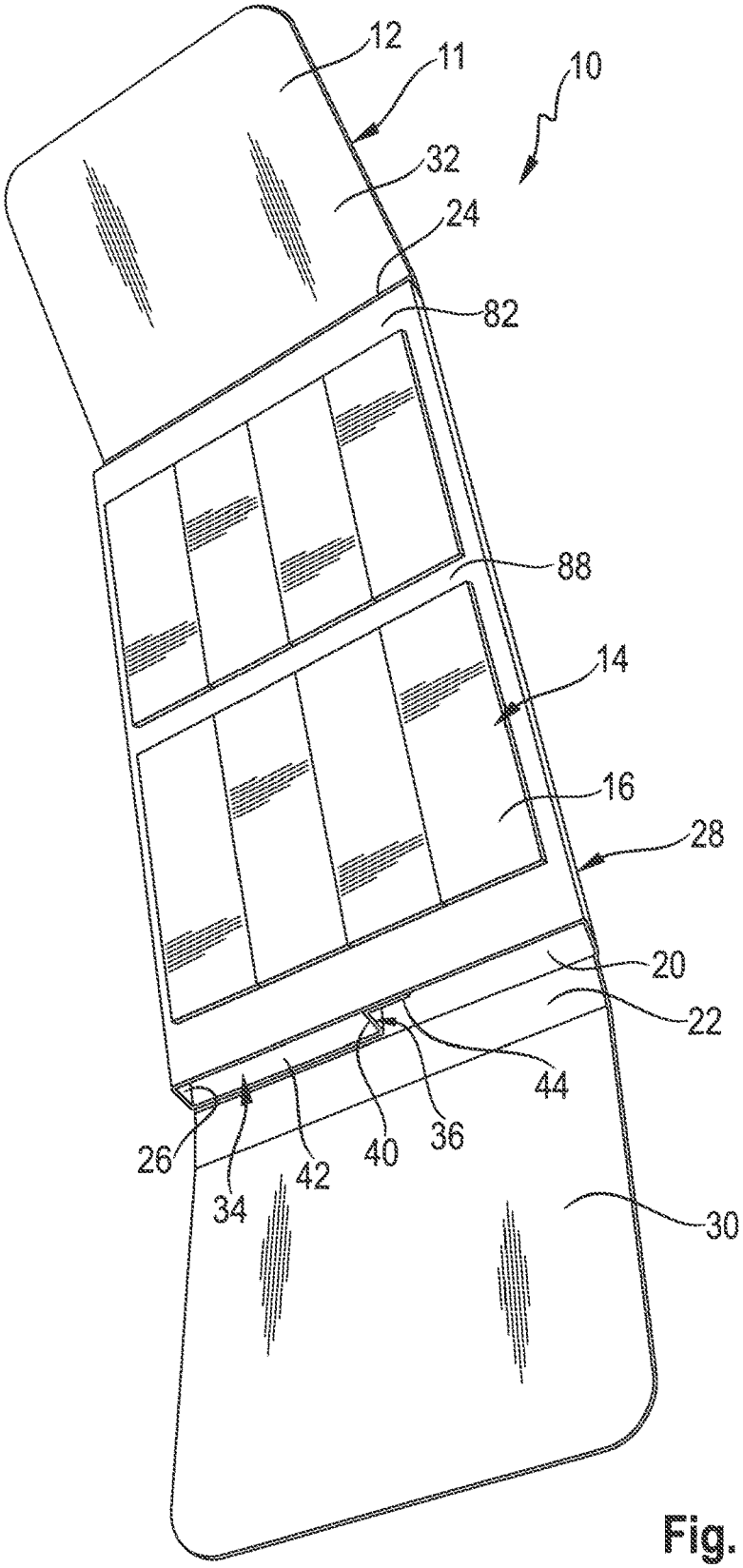
FIG. 1 shows a schematic perspective view of an example embodiment of a package kit comprising a first example embodiment of a package in an open position and a product stored therein.

A package in accordance with the present disclosure is unitarily formed of a cardboard blank, i.e. the package comprises one piece of cardboard which may be a single or multi layer cardboard. The package comprises a back wall, a first pair of side walls, a second pair of side walls, a first hinged lid section and a second hinged lid section. The side walls are positioned along the outer edges of the back wall. The side walls of the first pair and the side walls of the second pair, respectively, are arranged opposite each other, i.e. at opposite edges of the back wall and may extend from the back wall in a substantially perpendicular manner. In order to allow opening and closing of the package, each of the hinged lid sections extends from one of the side walls of the first pair in a hingeable manner. In other words, the first and the second hinged lid sections are hingeably connected to the respective side walls of the first pair. Such hingeable connection may be provided by means of a crease, a perforation or a folding line. When the package is set in its closed position, the first and the second hinged lid sections are positioned opposite and substantially parallel to the back wall.

A panel extends from one of the side walls of the second pair to the other side wall of the second pair. In other words, when the package is set in its closed position, the panel is arranged between the back wall and the first and the second hinged lid sections. The panel comprises at least one aperture into which a product is insertable. For example, the panel may comprise two rows of apertures, wherein each row may comprise three or four apertures. In other words, the at least one aperture is surrounded by the cardboard material of the panel which may be called "bordering of the aperture". The bordering of the at least one aperture may also be called "transverse and longitudinal bracings".

The product which may be stored in the package may comprise at least one blister package which may be inserted into the at least one aperture provided in the panel. Said blister package may comprise an oral care implement, for example a toothbrush head which may be repeatedly attachable to and detachable from a handle of a toothbrush, like an electrical toothbrush. For example, eight or less toothbrush heads may be provided in blister packages and may be stored in the package for shipment.

The panel extending from the one side wall to the other side wall of the second pair may provide the package with sufficient stiffness properties protecting the product stored in the package from getting damaged during shipping and distribution. The product may be delivered in a substantially undamaged manner. As the package may have sufficient stability to protect the product, substantially no protective padding and/or filling material and/or further boxes may be necessary to ensure that the product is delivered in a safe and undamaged manner resulting in a reduction of packaging material and costs. A package may be provided that can be shipped to a recipient without the need of additional packaging. As the need for a further box may be rendered unnecessary, the package may be called "shippable in own container" (SIOC).

The panel comprises at least one reinforcing brace which extends substantially perpendicular from the panel towards the back wall to provide the package with even more stability. The at least one reinforcing brace may extend from the panel to the back wall, i.e. the reinforcing brace may reach the inner surface of the back wall which may act as a support for the reinforcing brace. The at least one reinforcing brace may be arranged substantially parallel to one of the side walls of the first pair when the package is set in the closed position. The reinforcing brace may enable the package to take up/absorb compressive forces/loads which may be applied onto the outer surface of the back wall and/or onto the outer surface of the first hinged lid section and/or of the second hinged lid section.

The reinforcing brace may be a hinged reinforcing brace hingeably extending from the panel towards the back wall. A hingeable connection between the reinforcing brace and the panel may be provided by means of a crease, a perforation or a folding line. The hingeable connection may allow the at least one reinforcing brace to be flapped upwards and to be set in alignment with the panel to facilitate the package to be folded in a substantially flat position.

As the package may be closed by flapping the first and the second hinged lid sections in a position substantially parallel to the back wall, the package may be relatively easy to close, to open and to re-close in a relatively short period of time. The package in accordance with the present disclosure may allow easy access to its content.

The package may be sealed by means of an adhesive tape or foil bridging at least a portion of the first hinged lid section and at least a portion of the second hinged lid section. The adhesive tape or foil may display information regarding the distribution of the package and/or the product stored therein by a printing, for example the printing may provide identification markings, a barcode, a product description, the address of the sender/recipient and/or regulatory markings. In order to open the package, the adhesive tape or foil can be cut in the region in which the tape/foil bridges the first and the second hinged lid sections, for example by means of scissors or a knife. Thus, the package can be opened without substantially damaging the package in a relatively short period of time, e.g. within 120 seconds. As the package can be opened in a relatively short period of time in an easy manner, the so-called "out-of-box" experience for a user/recipient may be improved. In case the recipient of the package wants to re-use the package or wants to send the product back to sender after opening the package, the recipient may be enabled to re-close the package in an easy manner; a re-shipment of the product may be possible using the same package.

As the package is made of cardboard material which may be substantially recyclable, an environmentally sustainable package may be provided. Additionally, the package in accordance with the present disclosure can be re-used several times. Thus, an easy-to-open, recyclable cardboard package is provided that may reduce the overall amount of packaging material while the product stored in the package may still be protected from damages during storage and distribution.

The cardboard blank may have a weight of about 250 $g/m^2$ to about 600 $g/m^2$, optionally about 300 $g/m^2$ to about 500 $g/m^2$, further optionally about 400 $g/m^2$. A package having a cardboard weight of about 400 $g/m^2$ may provide sufficient stability of the package while the cardboard can still be easily flapped or folded along any hinges, creases or folding lines. Any hinged side walls and/or hinged lid sections may be relatively easy to flap into their required positions.

At least one of the side walls of the second pair may comprise an extension that forms a stiffening member to provide the package with increased stiffness. The stiffening member may extend from the side wall via a crease or a fold and may be arranged between the back wall and the panel.

The stiffening member may comprise a first leg, a second leg and a base which base may extend between the first leg and the second leg. The first leg and the second leg may be arranged substantially parallel to each other. The first leg and the second leg may extend from the base in a substantially perpendicular manner in opposite directions.

The first leg may extend from the side wall and may be attached to the back wall by means of adhesive tape applications and/or an adhesive while the second leg may extend from the base and may be attached to the panel by means of adhesive tape applications and/or an adhesive. In other words, the base may extend between the panel and the back wall to act as a support for the panel and/or back wall if pressure is applied onto the package. Further, the first leg and the second leg may provide the package with more stiffness/form stability in a lateral direction. The stiffening member may enable the package to take up/absorb compressive forces/loads which may be applied onto the outer surface of the back wall and/or onto the outer surface of the first hinged lid section and/or of the second hinged lid section.

The first leg and the base may each extend substantially along the overall length extension of the package while the second leg may be split into two, three or more sections. These sections may be attached to transverse bracings of the panel. For example, in case the panel comprises two rows of apertures along the length extension of the package, the second leg may be divided into three sections, each of them being attached to a transverse bracing.

At least one of the side walls of the first pair may be a hinged side wall hingeably extending from the back wall. A hingeable connection between the at least one hinged side wall and the back wall may be provided by means of a crease, a perforation or a folding line. The hingeable connection may allow the at least one hinged side wall to be flapped downwards and to be set in alignment with the back wall to facilitate insertion and removal of the product in an easy manner.

The package may have a length extension of about 150 mm to about 350 mm, optionally of about 195 mm to about 334 mm when the package is set in the closed position.

The package may have a width extension of about 100 mm to about 250 mm, optionally of about 125 mm to about 234 mm when the package is set in the closed position.

The package may have a height extension of about 11 mm to about 40 mm, optionally of about 18 mm when the package is set in the closed position.

A length extension of about 195 mm to about 334 mm, a width extension of about 125 mm to about 234 mm and a height extension of about 18 mm may provide a package which may be suitable for insertion into a regular mailbox. A so-called "frustration-free-package" may be provided which can be delivered in the mailbox of a recipient. The package does not have to be stored at the local post office in case the recipient is not available to accept delivery of the package.

The package may be free of any indentations, extrusions, windows and/or cut-outs to provide a package being optimized for efficient handling and transportation. Such packages may be relatively easy to stack for storage, conveyance and shipping.

The following is a non-limiting discussion of example embodiments of packages in accordance with the present disclosure, where reference to the Figures is made.

Figure 2:
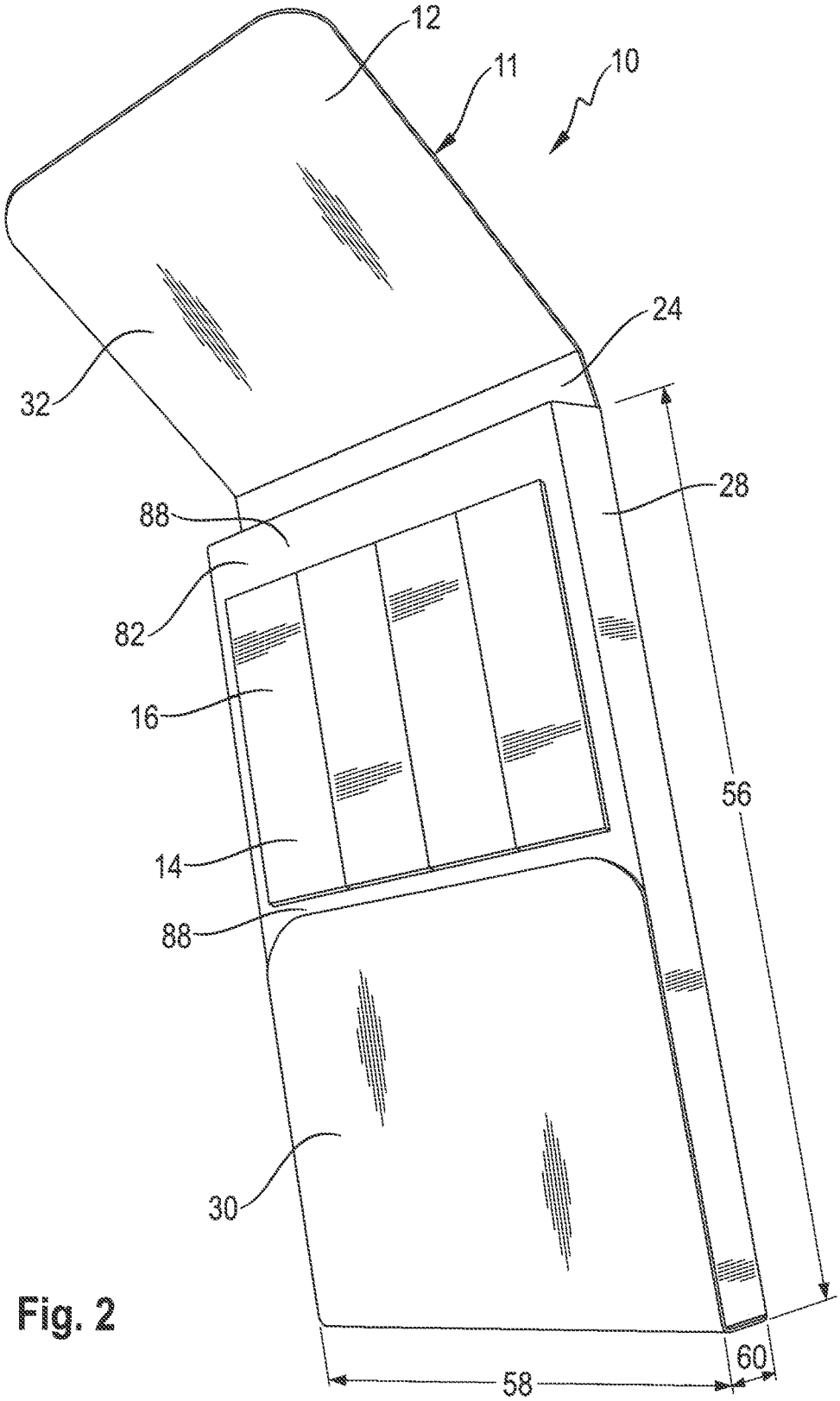
FIG. 2 shows a schematic perspective view of the package kit of FIG. 1 with a first hinged lid section set in a closed position and a second hinged lid section set in an open position.

FIGS. 1 and 2 show a perspective view of a package kit 10 comprising a package 11 unitarily formed from a cardboard blank 12 and a product 14 stored within the package 11. FIG. 1 shows the package 11 in an open position. The product 14 may comprise, e.g., a plurality of oral care implements such as, e.g., six or eight toothbrush heads, each of them being repeatedly attachable to and detachable from a handle of an electrical toothbrush. Each of the oral care implements may be packed in a blister package 16.

The package 11 comprises a back wall 20, a first pair of side walls 22, 24, a second pair of side walls 26, 28, a first hinged lid section 30 and a second hinged lid section 32. The side walls 22, 24 of the first pair are arranged opposite each other along opposite edges of the back wall 20 and may extend from the back wall 20 in a substantially perpendicular manner. The side walls 22, 24 of the first pair may be provided as hinged side walls 22, 24 hingeably extending from the back wall 20. The first hinged lid section 30 extends from one of the side walls 22 of the first pair and the second hinged lid section 32 extends from the other side wall 24 of the first pair in a hingeable manner. When the package 11 is set in its closed position, the first and the second hinged lid sections 30, 32 are arranged opposite the back wall 20. FIG. 2 shows the package 11, wherein the first hinged lid section 30 is set in the closed position.

The side walls 26, 28 of the second pair are arranged opposite each other along opposite edges of the back wall 20 and may extend from the back wall 20 in a substantially perpendicular manner.

The package 11 further comprises a panel 82 which extends from one of the side walls 26 of the second pair to the other side wall 28 of the second pair. The panel 82 may comprise eight apertures 84 being arranged in two rows with regard to the width extension 58 of the package 11. Each row may comprise four apertures 84. In other words, the panel 82 may be divided into a plurality of transverse bracings 88 and longitudinal bracings 90. Into each aperture 84 a blister package 16 may be inserted. Each blister package 16 may be supported at its outer edges by the transverse and longitudinal bracings 88, 90. When the package 11 is in the closed position, the panel 82 is arranged between the back wall 20 and the first and the second hinged lid sections 30, 32.

Figure 3:
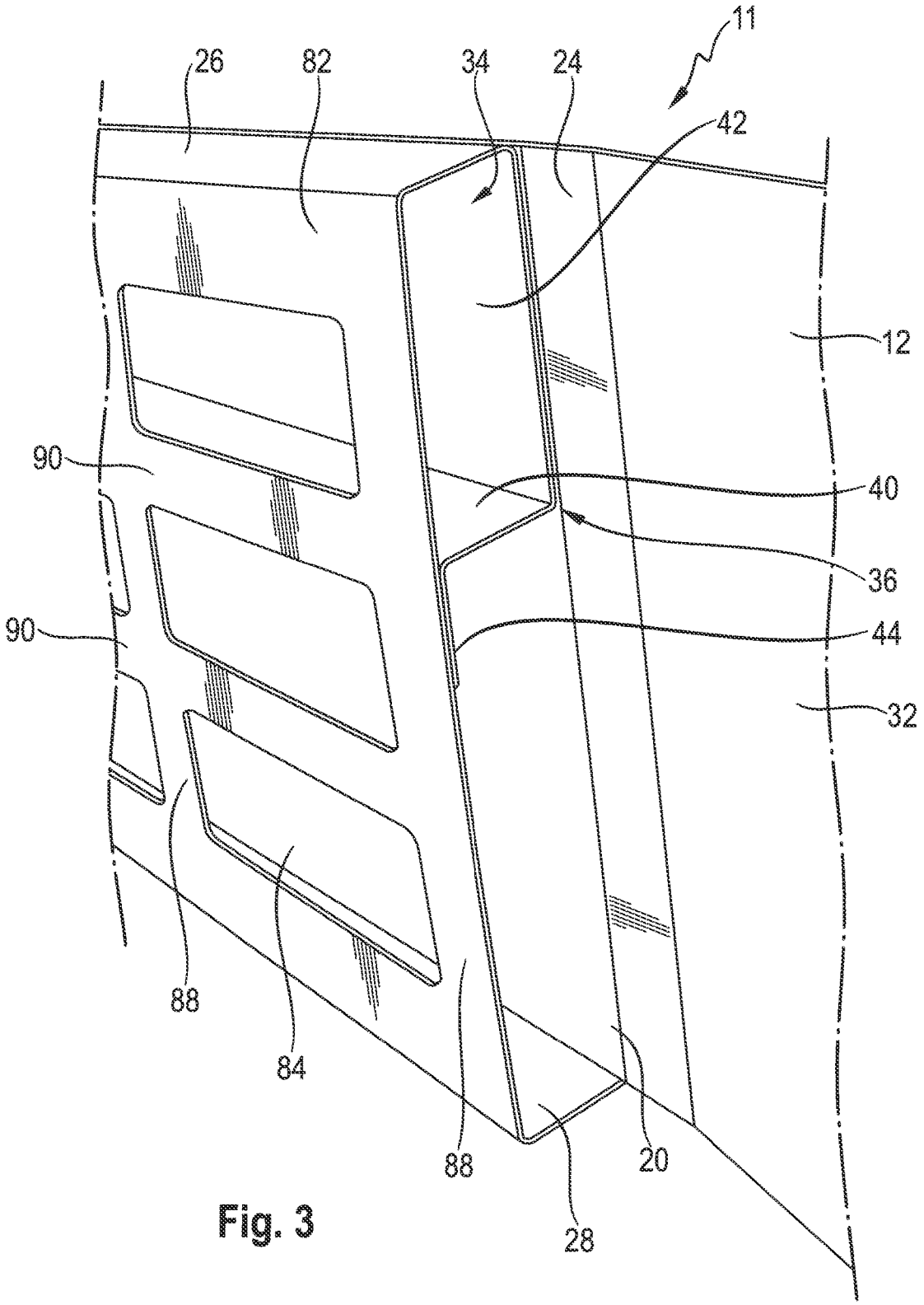
FIG. 3 shows a schematic perspective view of the package of FIG. 1.

As shown in FIGS. 1 and 3 at least one of the side walls 26 of the second pair may comprise an extension 34 that may form a stiffening member 36 to provide the package 11 with more stability/stiffness. The stiffening member 36 may comprise a first leg 42, a second leg 44 and a base 40. The first leg 42 may extend from the side wall 26 of the second pair via a crease in a substantially perpendicular manner and may be attached to the back wall 20 by means of adhesive tape applications and/or an adhesive. The base 40 may extend from the first leg 42 via a crease in a substantially perpendicular manner and may reach the panel 82. The second leg 44 may extend from the base 40 via a crease in a substantially manner and may be attached to the panel 82 via adhesive tape applications and/or an adhesive. In other words, the base 40 may be arranged substantially perpendicular with respect to the first and the second legs 42, 44. The first leg 42 and the second leg 44 may be arranged substantially parallel to each other and may extend from the base 40 in opposite directions, i.e. the second leg 44 may extend in a direction towards the other side wall 28 of the second pair. The stiffening member 36 may extend substantially along the overall length extension 56 of the package 11.

In other words, the base 40 may extend substantially along the overall length extension 56 of the package 11 between the panel 82 and the back wall 20 to act as a support in case pressure is applied onto the back wall 20 and/or onto the first and/or the second hinged lid sections 30, 32. The first leg 42 and the second leg 44 may provide the package 11 with more stiffness/form stability in a lateral direction.

Figure 4:
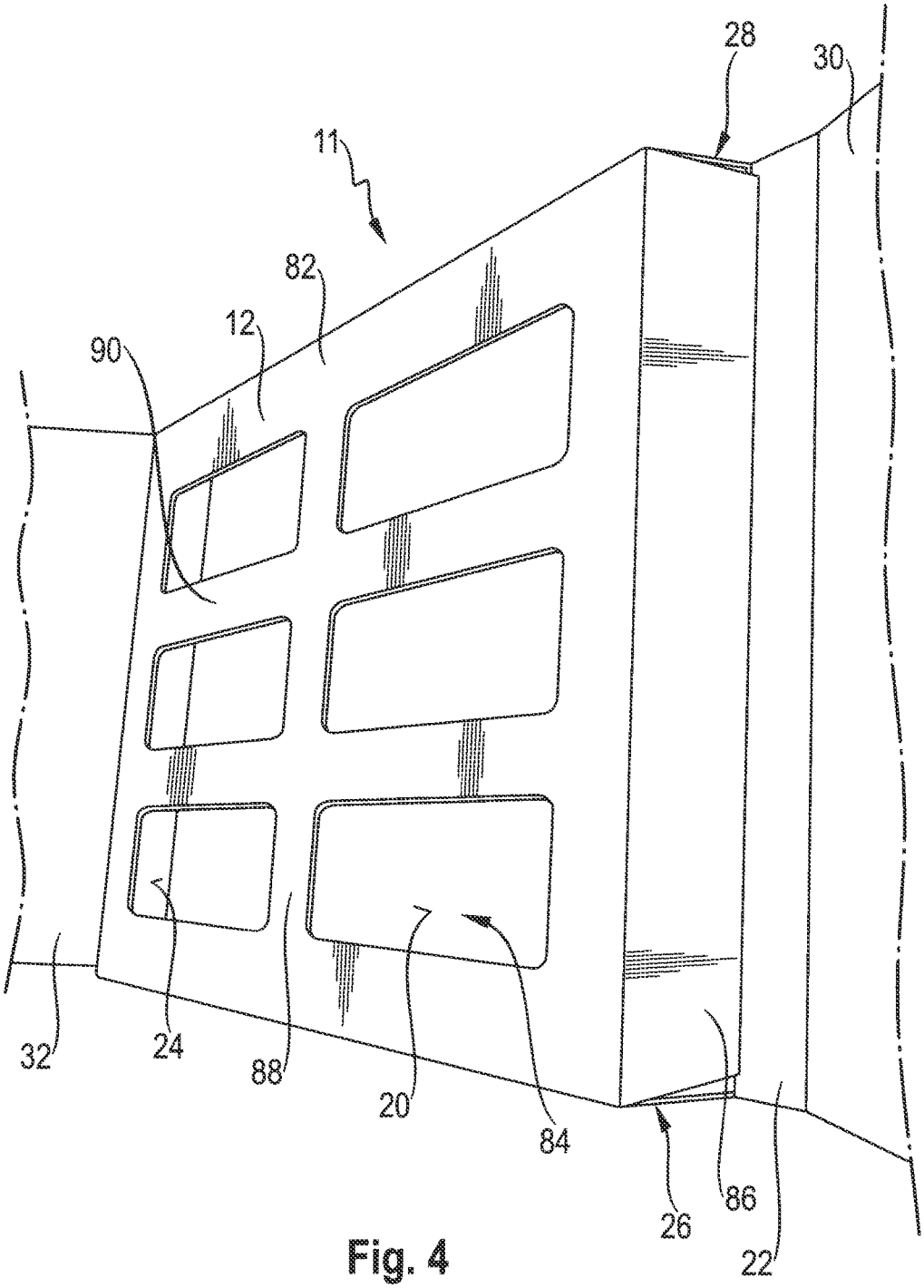
FIG. 4 shows a schematic perspective view of a second example embodiment of a package in an open position.

The package 11 as shown in FIG. 4 is similar to the package as shown in FIGS. 1, 2 and 3. However, the panel 82 may comprise at least one reinforcing brace 86 to provide the package 11 with even more stability/stiffness. The reinforcing brace 86 may extend from the panel 82 towards the back wall 20 in a substantially perpendicular manner. The reinforcing brace 86 may reach the back wall 20 so that the back wall 20 may act as a support for the reinforcing brace 86. When the package 11 is set in the closed position, the at least one reinforcing brace 86 may be arranged substantially parallel the side wall 22 of the first pair.

In order to allow the at least one reinforcing brace 86 to be flapped upwards and to be set in alignment with the panel 82 to facilitate the package to be folded in a substantially flat position, the reinforcing brace 86 may be a hinged reinforcing brace 86 extending from the panel 82 in a hingeable manner. In other words, the reinforcing brace 82 may be hingeably connected to the panel 82. Such hingeable connection may be provided by means of a crease, a perforation or a folding line.

When the package 11 is set in its closed position, the package 11 may have a length extension 56 of about 150 mm to about 350 mm, optionally of about 195 mm to about 334 mm, a width extension 58 of about 100 mm to about 250 mm, optionally of about 125 mm to about 234 mm, and a height extension 60 of about 11 mm to about 40 mm, optionally of about 18 mm.

In the present context, the term "substantially" refers to an arrangement of elements or features that, while in theory would be expected to exhibit exact correspondence or behavior, may, in practice embody something slightly less than exact. As such, the term denotes the degree by which a quantitative value, measurement or other related representation may vary from a stated reference without resulting in a change in the basic function of the subject matter at issue.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A package unitarily formed from a cardboard blank for storing a product, the package comprising:

a back wall, a first hinged lid section and a second hinged lid section to set the package in an open or a closed position, the first and second hinged lid sections being opposite to the back wall when the package is set in the closed position, a first pair of side walls, the side walls of the first pair being arranged opposite to each other and extending from the back wall, the first hinged lid section extending from one of the side walls of the first pair and the second hinged lid section extending from the other side wall of the first pair, a second pair of side walls, the side walls of the second pair being arranged opposite to each other and extending from the back wall, and a panel comprising at least one aperture for receiving the product, wherein the panel extends from one of the side walls of the second pair to the other side wall of the second pair and is arranged between the back wall and the first and the second hinged lid sections when the package is set in the closed position, wherein the panel comprises at least one reinforcing brace extending substantially perpendicular from the panel towards the back wall, wherein at least one of the side walls of the second pair includes an extension that forms a stiffening member comprising a first leg adjacent to the back wall, a second leg adjacent to the panel, and a base extending between and substantially perpendicular to the first leg and the second leg, the first leg and the second leg being arranged substantially parallel to each other and extending from the base in mutually opposite directions, and wherein the first hinged lid and the second hinged lid are positioned in such a way that a single piece of tape bridges at least a portion of the first hinged lid and at least a portion of the second hinged lid section when the package is set in the closed position.

2. The package of claim 1, wherein the first leg extends from one of the side walls of the second pair of side walls and is attached to the back wall, and the second leg extends from the base and is attached to the panel.

3. The package of claim 1, wherein the cardboard blank has a weight of about 250 $g/m^2$ to about 600 $g/m^2$.

4. The package of claim 1, wherein the at least one reinforcing brace is a hinged element extending from the panel.

5. The package according to claim 1, wherein at least one of the side walls of the first pair is a hinged side wall hingeably extending from the back wall.

6. The package of claim 1, wherein the package has a length extension of from about 150 mm to about 350 mm when the package is in the closed position.

7. The package of claim 1, wherein the package has a width extension of from about 100 mm to about 250 mm when the package is in the closed position.

8. The package of claim 1, wherein the package has a height extension of from about 11 mm to about 40 mm, when the package is in the closed position.

9. A package kit comprising the package of claim 1 and a product.

10. The package kit of claim 9, wherein the product comprises at least one blister package.

11. The package kit of claim 9, wherein the product comprises at least one oral-care implement.

12. The package of claim 1, wherein the cardboard blank has a weight of from about 300 $g/m^2$ to about 500 g/m.

13. The package of claim 1, wherein the cardboard blank has a weight of about 400 $g/m^2$.

* * * * *